US006163671A

United States Patent [19]

Ishiyama et al.

[11] Patent Number: 6,163,671

[45] Date of Patent: Dec. 19, 2000

[54] CONTACT CHARGER HAVING CHARGING PERFORMANCE ENHANCING PARTICLES EXISTING AT A CONTACT PORTION BETWEEN THE CONTACT CHARGER AND THE MEMBER TO BE CHARGED

[75] Inventors: Harumi Ishiyama, Numazu; Yasunori Chigono, Susono; Jun Hirabayashi, Numazu, all of Japan

[73] Assignee: Canon Kabushiki Kaisha, Tokyo, Japan

[21] Appl. No.: 09/389,373

[22] Filed: Sep. 3, 1999

[30] Foreign Application Priority Data

Sep. 4, 1998 [JP] Japan ..... 10-267406

[51] Int. Cl.[7] ..... G03G 15/02

[52] U.S. Cl. ..... 399/176

[58] Field of Search ..... 399/176, 115, 399/168, 174, 175; 361/225

[56] References Cited

U.S. PATENT DOCUMENTS 4,851,960 7/1989 Nakamura et al. ..... 361/225
5,432,037 7/1995 Nishikiori et al. ..... 430/126
5,815,777 9/1998 Hirabayashi ..... 399/174

FOREIGN PATENT DOCUMENTS 6-3921 1/1994 Japan .
7-99772 10/1995 Japan .
10-307458 11/1998 Japan .
11-153897 6/1999 Japan .

*Primary Examiner*—Quana M. Grainger
*Attorney, Agent, or Firm*—Fitzpatrick, Cella, Harper & Scinto

[57] ABSTRACT

A charging apparatus for charging a member to be charged includes a charging member for contacting to the member to be charged to electrically charge it; charging performance enhancing particles existing at a contact portion between the charging member and the member to be charged; wherein the charging performance enhancing particles is triboelectrically charged at the contact portion to a polarity opposite from that of a voltage applied to the charging member.

12 Claims, 5 Drawing Sheets

CONTACT CHARGER HAVING CHARGING PERFORMANCE ENHANCING PARTICLES EXISTING AT A CONTACT PORTION BETWEEN THE CONTACT CHARGER AND THE MEMBER TO BE CHARGED

FIELD OF THE INVENTION AND RELATED ART

The present invention relates to a charging apparatus suitable for an image forming apparatus which employs an electraphotographic system or an electrostatic recording system.

In the past, a corona discharging apparatus (corona type charging device) has been widely used as a charging apparatus for charging (inclusive of "removing charge from") an image bearing member (member to be charged), for example, an electrophotographic photosensitive member, an electrostatically recordable dielectric member, or the like, in an image forming apparatus, for example, an electrophotographic apparatus, an electrostatic recording apparatus, or the like, to predetermined polarity and potential level.

A corona discharging apparatus is a noncontact type charging apparatus. It comprises an ion discharging electrode constituted of, for example, a piece of wire or the like, and an electrode in the form of a shield which surrounds the ion discharging electrode. The shield electrode is provided with an ion discharging opening directed toward the surface of an object to be charged, but, not in contact with the object. In operation, high voltage is applied between the ion discharging electrode and the shield electrode to generate discharge current (corona shower) to which the surface of the object is exposed to be charged to predetermined polarity and potential level.

Contact Charge

In recent years, a contact type charging apparatus has been put to practical use because of its advantages, for example, being low in ozone production electric power consumption. A contact type charging apparatus comprises a charging member, which is placed in contact with an object to be charged. In a charging operation, electrical voltage is applied to the charging member placed in contact with the object to be charged.

A contact type charging apparatus comprises an electrically conductive charging member in the form of, for example, a roller (charge roller), a fur brush, a magnetic brush, or a blade, which is placed in contact with a member to be charged. In operation, charge bias, or electrical voltage with a predetermined potential level, is applied to the contact charging member (contact type charging member, contact type charging device: hereinafter, "contact type charging member"), which is placed in contact with a member to be charged, for example, an image bearing member or the like, so that the peripheral surface of the object to be charged is charged to predetermined polarity and electrical potential.

The charging mechanism (charging principle) in a contact type charging apparatus comprises of a mixture of two charging mechanism: (1) a mechanism based on electrical discharge, and (2) a mechanism based on direct injection of electrical charge. Thus, the characteristics of a contact type charging apparatus vary depending on which of the two mechanisms is dominant.

(1) Charging Mechanism Based on Electrical Discharge

This is a charging mechanism which charges the peripheral surface of an object to be charged, with the use of the electrical discharge which occurs through a microscopic gap between a contact type charging member and the object to be charged.

In a charging system based on electrical discharge, there is a certain threshold value depending on the characteristics of a contact type charging member and an object to be charged. Thus, in order for an object to be charged to a predetermined potential level, voltage, the potential level of which is greater than the predetermined voltage level, must be applied to a contact type charging member. In addition, an electrical discharge based charging system inherently produces by-products, the amount of which, however, may be extremely small compared to those produced by a corona based charging device. Therefore, even if a contact type charging system is employed, it is impossible to completely avoid the problems caused by active ions such as ozone.

A charging system which employs a contact type charging member, for example, an electrically conductive roller (charge roller) is widely used to charge an object because of its desirable characteristic, that is, safety.

In the case of a charging roller, the charging mechanism based on electrical discharge (1) is the dominant charging mechanism.

More specifically, a charge roller is formed of rubber or foamed material which is electrically conductive, or the electrical resistance of which is in the medium range. Sometimes, different materials are layered in order to obtain a predetermined characteristic.

A charge roller is provided with elasticity so that a predetermined state of contact can be kept between the charge roller and an object to be charged. Therefore, a charger roller has a large frictional resistance on its peripheral surface. Generally, it is enabled to follow the rotation of a photosensitive member, or is driven at a speed slightly different from that of the photosensitive member. Thus, it cannot be avoided that sometimes the contact between itself and the photosensitive drum is lost due to the irregularities of the peripheral surface of the charge roller and/or the contaminants adhered to the photosensitive member. In other words, in the case of a conventional charging roller, the charging mechanism based on electrical discharge is dominant in charging an object.

To describe in more detail, when a charge roller is placed in contact with a photosensitive drum, as an object to be charged, with a 25 $\mu$m thick photoconductor layer, with the application of a predetermined pressure to charge the photosensitive member, the surface potential level of the photosensitive drum begins to rise as the potential level of the voltage applied to the charge roller is increased beyond approximately 640 V. Beyond 640 V, the surface potential level of the photosensitive drum linearly increases at an inclination of 1. This threshold potential level is defined as a charge initiation voltage Vth.

In other words, in order to increase the surface potential level of a photosensitive drum to a potential level of Vd, a DC voltage with a potential level of Vd+Vth, which is greater than the target surface potential level for the photosensitive drum, is necessary. This method in which only DC voltage is applied to a contact type charging member to charge an object is called a DC charge system.

However, it is rather difficult to change the potential level of a photosensitive member to a desired level with the use of a DC charge system, because the resistance of a contact type charging member varies due to changes in ambience or the like, and also because the value of Vth changes as the thickness of the surface layer of the photosensitive member as an object to be charged, changes as it is shaved.

Thus, various proposals to uniformly and reliably charge a photosensitive drum have been made. Among such proposals, U.S. Pat. No. 4,851,960 discloses an AC charge system, according to which in order to charge an image bearing member, an oscillatory compound voltage composed of a DC voltage equivalent to a desired potential level Vd and an AC voltage with a peak-to-peak voltage of 2×Vth is applied to a contact type charging member. This proposal intended that AC voltage be used to make the potential level uniform. As a result, the potential level of an object to be charge converges to the voltage value of Vd, the center of the top and bottom peaks of the AC voltage, which is not affected by external disturbance such as changes in ambience or the like.

However, even in the case of such a contact type charging apparatus as the one described above, its charging mechanism principally relies on the electrical discharge which occurs from a contact type charging member to an image bearing member. Therefore, the potential level of the voltage applied to a contact type charging member needs to have a value greater than the sum of the potential level to which a photosensitive drum is to be charged, and the potential level of the aforementioned threshold voltage for electrical discharge. As a result, ozone is produced, although the amount is microscopic.

Further, when an AC charge system is used for the uniformity of charge, an additional amount of ozone is generated, and the contact type charging member and the photosensitive member are vibrated by the electric field generated by the AC voltage, which results in noises (AC charge noises). Further, the deterioration or the like of the peripheral surface of the photosensitive drum is very severe. These are new problems.

(2) Mechanism Based on Direct Electrical Charge Injection

This is a charging system in which electrical charge is directly injected into an object from a contact charging member so that the peripheral surface of the object is electrically charged, which has been proposed in Japanese Laid-Open Patent Application No. 3921/1994 or the like.

More specifically, a contact type charging member, the electrical resistance of which is in a medium range, is placed in contact with the peripheral surface of an object to be charged, to charge the object without triggering the electrical discharge. In other words, this charging mechanism is a charging mechanism which directly injects electrical charge into the peripheral surface of an object to be charged. Principally, it does not rely on electrical discharge. Therefore, even if the potential level of the voltage applied to a contact type charging member is less than a threshold voltage level, the object to be charged can be charged to a potential level substantially equal to the potential level of the applied voltage.

Since this direct injection charging system does not involve ion generation, it does not suffer from the ill effects associated with the by-products of electrical discharge.

In other words, this is a mechanism for charging an object to be charged, by directly injecting electrical charge into the object. More specifically, it is a mechanism in which voltage is applied to a contact type charging member, for example, a charge roller, a charge brush, or a magnetic charge brush, to directly inject electrical charge into the traps, or the charge holding member such as electrically conductive particles or the like in the charge injection layer, in the peripheral surface of the object to be charged (image bearing member). In this mechanism, electrical discharge is not a dominant factor. Therefore, the potential level of the voltage necessary to charge the object has only to be as high as the potential level to which the object (image bearing member) is desired to be charged. Further, the ozone production does not occur.

An example of the aforementioned charging mechanism based on electrical discharge (1) and an example of the aforementioned charging mechanism based on direction injection of electrical charge (2) are shown in FIG. 7.

As is represented by a line A in FIG. 7, the charging of an object by a charging mechanism based on electrical discharge occurs when the potential level of the voltage applied to a charging member is above approximately −500, an electrical discharge threshold value. Therefore, generally, in order to charge an object a a potential level of −500 V, either a DC voltage of −1000 V is applied to the charge roller, or an AC voltage with a peak-to-peak voltage of 1200 V is applied to the charge roller, in addition to a DC voltage of −500 V, so that a difference in potential level greater than the threshold voltage value is always present between the charging member and the object to be charged, and so that the potential level of the photosensitive drum converges to the predetermined potential level.

On the other hand, in the case of a charging mechanism based on direct injection of electrical charge, there is no electrical discharge threshold value as is depicted by a line B in FIG. 7. Thus, when this charging mechanism is employed, it is possible to charge an object to a potential level substantially proportional to the potential level of the voltage charged to a charging member.

Toner Recycling Process (Cleaner-less System)

In a transfer type image forming apparatus, the residual toner, or the toner which remains on a photosensitive drum (image bearing member) after image transfer, is removed from the peripheral surface of the photosensitive drum by a cleaner (cleaning apparatus) and becomes waste toner. From the standpoint of environmental protection, it is desired that waste toner is not produced. Thus, an image forming apparatus which employs a toner recycling process has been realized. In this type of an image forming apparatus, the residual toner which remains on a photosensitive drum after image transfer is removed from the photosensitive member by a developing apparatus (developing-cleaning process). In other words, the residual toner is recovered by the developing apparatus, and is reused.

The developing-cleaning process is a process in which the toner remaining on a photosensitive drum after image transfer is recovered by a fog removal bias (difference Vback between potential level of DC voltage applied to developing apparatus and potential level of peripheral surface of photosensitive member) during the development of a latent image which follows image transfer, in other words, during development of a latent image formed by charging the photosensitive member and exposing the charged photosensitive member in the immediately following image formation cycle. According to this method, the residual toner is recovered by a developing apparatus and is used in the following image formation cycles. In other words, no toner is wasted; waste toner is not produced, reducing the amount of maintenance labor. Further, being cleaner-less makes a cleaner-less image forming apparatus advantageous in term of space; a cleaner-less image forming apparatus can be drastically smaller compared to an image forming apparatus with a cleaner.

Coating of Particles on Contact Type Charging Member

Japanese Patent Publication Application No. 99772/1995 discloses a structure for a contact type charging apparatus, which is for charging an object uniformly and reliably, that is, which can prevent an object from being nonuniformly charged. According to this structure, powder is placed in the contact surface between a contact type charging member and an object to be charged, in order to uniformly charge an object.

U.S. Pat. No. 5,432,037 also discloses an innovative image forming method which employs a contact type charging method. According to this patent, in order to prevent toner particles and/or microscopic silica particles from adhering to the surface of a charging means as an image forming cycle is repeated for a long period of time, electrically conductive particles, the average diameter of which is smaller than that of the developer particles, is mixed into developing agent.

Further, the applicants of the present invention have also proposed an innovative charging method which relies on charge injection. This method is disclosed in Ser. No. 35109. It uses charging performance enhancing particles.

A charging method which uses charging performance enhancing particles has various merits. However, as the amount of the electrically conductive particles falls below a certain level, or a critical level, an object to be charged is liable to be nonuniformly charged. Therefore, in order to uniformly charge an object, the amount of the charging performance enhancing particles must be prevented from falling below a critical level.

SUMMARY OF THE INVENTION

The primary object of the present invention is to provide a charging apparatus capable of charging an object to be charged, with the presence of electrically conductive particles in the charging nip.

Another object of the present invention is to provide a charging apparatus which is small in the consumption of electrically conductive particles.

Another object of the present invention is to provide a charging apparatus comprising a charging member for charging an object to be charged, by coming in contact with the object; charging performance enhancing particles which are present in the contact portion between the object to be charged, and the charging member, wherein the charging performance enhancing particles are triboelectrically charged in the contact portion, to the polarity opposite to the polarity of the voltage applied to said charging member.

These and other objects, features and advantages of the present invention will become more apparent upon a consideration of the following description of the preferred embodiments of the present invention taken in conjunction with the accompanying drawings.

DESCRIPTION OF THE PREFERRED EMBODIMENTS

Figure 1:
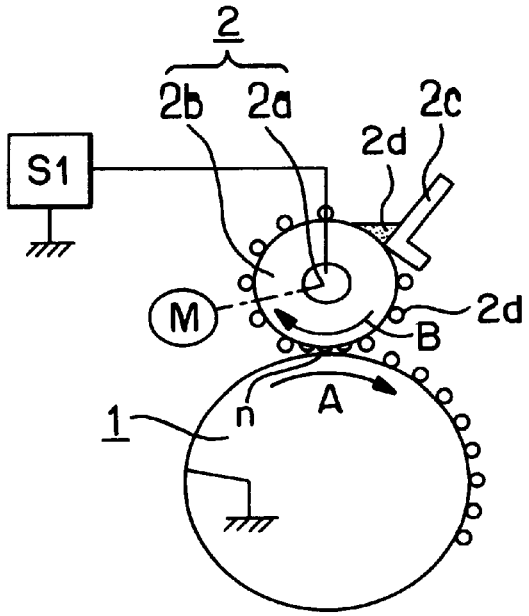
FIG. 1 is a schematic sectional view of the charging apparatus in the first embodiment of the present invention, and depicts the general structure of the apparatus.
Figure 2:
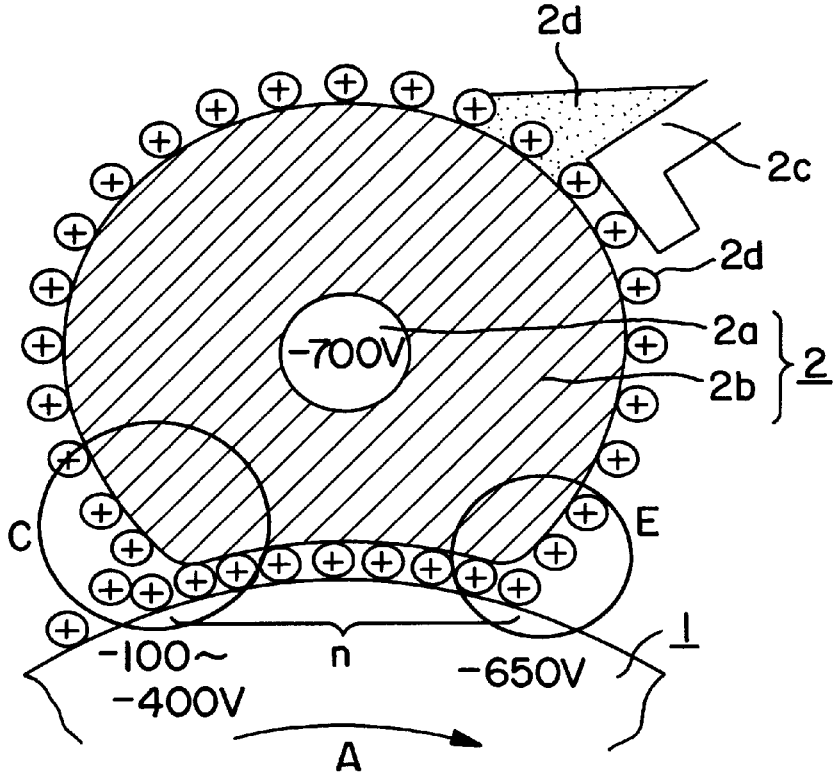
FIG. 2 is a schematic drawing for describing a direct charge injection process which involves the presence of charging performance enhancing particles.

Embodiment 1 (FIGS. 1 and 2)

FIG. 1 is a schematic sectional view of an example of a contact type charging apparatus, that is, a charging apparatus which directly injects electrical charge into an object to be charged, in accordance with the present invention.

(1) Object to be Charged

A referential character 1 designates an object to be charged, which, in this embodiment, is an electrophotographic photosensitive member (hereinafter, "photosensitive drum") in the form of a drum with a diameter of 30 mm, and is rotationally driven in the clockwise direction indicated by an arrow mark A at a predetermined constant velocity.

Along the peripheral surface of this photosensitive drum 1, processing means necessary for image formation, for example, an exposing means, a developing means, a cleaning means, and the like, are disposed in addition to the contact type charging member, constituting the essential portion of an image forming apparatus. However, these components are not illustrated in the drawing.

(2) Contact Type Charging Member

A referential character 2 designates a contact type charging member, which in this embodiment is an electrically conductive elastic roller (hereinafter, "charge roller") disposed in contact with the photosensitive drum 1 with the application of a predetermined amount of pressure. A reference character n designates a nip formed between the photosensitive drum 1 and charge roller 2. The charge roller 2 is rotationally driven at a constant peripheral velocity equal to that of the photosensitive drum 1 so that the moving direction of its peripheral surface in the nip n becomes opposite (counter) to the moving direction A of the photosensitive drum 1 in the nip n, and provides a difference in velocity between the peripheral surfaces of the photosensitive drum 1 and charge roller 2. Designated by a referential character M is a power source for driving the charge roller 2. To the charge roller 2, charge bias with a predetermined potential level, which in this embodiment is a DC voltage of −700 V, is applied from a charge bias application power source S1.

The charge roller 2 in this embodiment is a contact type charging member which is flexible. It comprises a metallic core 2*a* and an elastic layer 2*b* wrapped around the metallic core 2*a*. The electrical resistance of the elastic layer 2*b* is in the medium range. The material for the elastic layer 2*b* with an intermediary electrical resistance is a mixture of resin (for example, urethane), electrically conductive particles (for example, carbon black particles), sulfurizing agent, and the like, and is coated on the metallic core 2*a*. After the coating, the surface of the elastic layer 2*b* is polished to complete the charge roller 2, an electrically conductive roller, which is 12 mm in diameter and 250 mm in length.

The measured electrical resistance of the charge roller 2 in this embodiment was 100 k.ohm. The method used to measure the electrical resistance was as follows. First, the peripheral surface of the charge roller 2 was directly pressed upon the peripheral surface of an aluminum drum with a diameter of 30 mm by applying an overall weight of 1 kg to the metallic core 2*a* of the charge roller 2, and the measurement was made while applying 100 V between the metallic core 2*a* and the aluminum drum.

It is very important that the charge roller 2, a contact type charging member, also functions as an electrode. In other words, not only must the charge roller 2 be provided with a sufficient amount of elasticity so that it creates and maintains a satisfactory state of contact between itself and an object to be charged, but also it must be low in electrical resistance so that a moving object can be charged to a satisfactory potential level. On the other hand, the charge roller 2 must be capable of preventing a voltage leak which might occur if an object to be charged has defects such as a pin hole. Thus, when an object to be charged is an electrophotographic photosensitive member, the electrical resistance of the charge roller 2 is desired to be in a range of $10^4$–$10^7$ ohm so that the object can be satisfactorily charged while preventing a voltage leak.

The peripheral surface of the charge roller 2 is desired to be provided with microscopic irregularities so that it can hold charging performance enhancing particles 2*d,* which will be described later.

As for the hardness of the charge roller 2, if the charge roller 2 is extremely low in hardness, it is unstable in terms of shape, failing to maintain the satisfactory state of contact between itself and an object to be charged, whereas if it is extremely high in hardness, not only does it fail to create a satisfactory charging nip n between itself and the object to be charged, but also it is inferior in the state of contact in terms of a microscopic between itself and the object to be charged level. Therefore, the hardness of the charge roller 2 is desired to be in a range of 25 deg. to 50 deg. in Asker C hardness scale.

As for the elastic material for the charge roller 2, it is possible to list rubbery materials such as EPDM, urethane, NBR, silicone rubber, IR, or the like, in which an electrically conductive substance, for example, carbon black or metallic oxide is dispersed to adjust electrical resistance. It is also possible to adjust the electrical resistance of the material with the use of an ion conductive substance instead of dispersing the electrically conductive substance. Further, the electrical resistance of the material for the charge roller 2 can be adjusted with the use of a mixture of metallic oxide and an ion conductive substance.

The charge roller 2 is pressed upon the photosensitive drum 1 as an object to be charged, with the application of a predetermined amount of pressure, so that the charge nip n with a width of several millimeters (in this embodiment) is formed between the peripheral surfaces of the charge roller 2 and the photosensitive drum 1 due to the elasticity of the surface layer of the charge roller 2.

(3) Charging Performance Enhancing Particles and Means for Coating (Supplying) Particles A referential character 2*c* designates a regulator blade as a means for supplying the charge roller 2 with charging performance enhancing particles by coating the particles on the charge roller 2. The regulator blade 2*c* is disposed so that its free edge portion contacts the charge roller 2 to hold the charging performance enhancing particles 2*d* between the charge roller 2 and the regulator blade 2*c*. In operation, as the charge roller 2 rotates, a predetermined amount of the charging performance enhancing particles 2*d* is coated on the peripheral surface of the charge roller 2, and then is carried to the charging nip, or the nip between the charge roller 2 and the photosensitive drum 1 as an object to be charged. The choice of the charging performance enhancing particles coating-supplying means does not need to be limited to the regulator blade 2*c;* it is optional. For example, a piece of foamed material or a fur brush, in which the charging performance enhancing particles 2*d* are held, may be placed in contact with the charge roller 2. This arrangement is simpler in structure.

In this embodiment, particles of zinc oxide, an n-type semiconductor, with a specific resistivity of $7\times10^3$ ohm.cm and an average diameter of 4.5 $\mu$m, are used as the charging performance enhancing particles 2*d.*

As for the material for the charging performance enhancing particle, various n-type semiconductors, for example, an electrically conductive particle of metallic oxide other than zinc oxide, a mixture between zinc oxide and an organic substance, can be used in addition to zinc oxide. More specifically, particles of titanium oxide or the like may be used.

For the efficient exchange of electrical charge, the resistivity of a charging performance enhancing particle is desired to be no more than $10^{12}$ ohm.cm, preferably no more than $10^{10}$ ohm.cm. However, if the resistivity of a charging performance enhancing particle is extremely low, it is difficult for the charging performance enhancing particle to be triboelectrically charged. Therefore, the resistivity is desired to be no less than $10^{-2}$ ohm.cm.

The electrical resistance of the charging performance enhancing particle is determined by measuring the electrical resistance of the charging performance enhancing particle by a tablet method and normalizing the results of the measurement. More specifically, 0.5 g of a test sample in the powder form is placed in a cylinder with a bottom surface area of 2.26 $cm^2$, and is compacted with a pressure of 15 kg applied through top and bottom electrodes. Then, the electrical resistance of the test sample was measured while applying a voltage of 100 V. Then, the thus obtained resistance value was normalized to obtain the resistivity of the sample.

For uniformity of charge, the particle diameter is desired to be no more than 50 $\mu$m. In the present invention, when each particle comprises aggregate of smaller particles (primary particles), in other words, each particle is a secondary particle, the particle diameter is defined as average particle diameter of the secondary particles. As for the method used for measuring the particle diameter in this embodiment, no fewer than 100 charging performance enhancing particles were selected, and their maximum horizontal cord lengths were measured with the use of an optical or electron microscope. Then, the volumetric particle diameter distribution was calculated based on the results of the measurement. Then, the 50% average particle diameter was used as the average particle diameter of the particle in this embodiment.

It does not matter whether each of the charging performance enhancing particles in each granule of the charging performance enhancing agent is in the primary state, that is, comprises of a single particle, or in the secondary state, that is, comprises two or more particles. In other words, as long as the charging performance enhancing agent properly functions as it is supposed to do, the state in which the charging performance enhancing particles aggregate is not important.

(4) Charging by Direct Injection

As the charging performance enhancing particles 2*d* are coated on (supplied to) the charge roller 2 by the regulator blade 2*c,* the particles 2*d* are conveyed to the charging nip between the photosensitive drum 1 and charge roller 2 by the rotation of the charge roller 2. Thus, the photosensitive drum 1 is directly charged with the presence of the charging performance enhancing particles 2*d* in the nip n.

With the presence of the charging performance enhancing particles 2*d* in the nip n between the photosensitive drum 1 and charge roller 2, even a charge roller which is difficult to keep rotating in contact with the photosensitive drum 1 while maintaining a predetermined difference in peripheral velocity between the peripheral surfaces of the charge roller 2 and photosensitive drum 1, because of the friction between the peripheral surfaces of the charge roller 2 and photosensitive drum 1, can be easily kept rotating in contact with the peripheral surface of the photosensitive drum 1 while maintaining the predetermined difference in peripheral velocity between the charge roller 2 and photosensitive drum 1. In addition, a larger number of electrical connections are established between the peripheral surfaces of the charge roller 2 and photosensitive drum 1 because of the presence of the charging performance enhancing particles 2*d* between the two surfaces. In other words, the charging performance enhancing particles 2*d* improve the state of electrical contact between the charge roller 2 as a contact type charging member and the photosensitive drum 1 by leveling the irregularities, that is, filling the recesses, in the peripheral surface of the charge roller 2.

Further, this embodiment allows a difference in peripheral velocity to be maintained between the charge roller 2 and photosensitive drum 1. Therefore, it is possible to drastically increase the number of the charging performance enhancing particles 2*d* which contact the photosensitive drum 1 in the nip n between the charge roller 2 and photosensitive drum 1, and the number of opportunities with which each charging performance enhancing particle contacts the photosensitive drum 1 in the nip n, so that the state of electrical contact between the charge roller 2 and photosensitive drum 1 is drastically improved. In addition, the charging performance enhancing particles 2*d* which are present between the peripheral surfaces of the charge roller 2 and photosensitive drum 1 rub the peripheral surface of the photosensitive drum 1, leaving virtually no gap between the two surfaces. Therefore, electrical charge can be directly injected into the photosensitive drum 1. In other words, when a proper amount of the charging performance enhancing particles is present between peripheral surfaces of the charge roller 2 and photosensitive drum 1, it is the direct charge injection that is dominant in the process in which the photosensitive drum 1 is charged though the contact between the photosensitive drum 1 and the charge roller 2.

In this embodiment, a DC voltage of −700 V was applied to the metallic core 2*a* of the charge roller 2. As a result, electrical charge was directly injected into the peripheral surface of the photosensitive drum 1, changing the potential level of the surface to a level approximately equal to the potential level of the voltage applied to the charge roller 2.

After image transfer, the peripheral surface of the photosensitive drum is not uniform in terms of potential level (for example, it ranges from −100 to −400 V) due to the attention of the potential caused by the exposing process, the effects of image transfer, the electrical discharge which occurs between a transfer medium and a transfer member, and the like. However, as electrical charge is injected into the peripheral surface of the photosensitive drum 1 in the charging nip, the potential level of the peripheral surface of the photosensitive drum 1 is changed, across its entire surface, to approximately −680 V which is substantially equal to −700 V applied to the charge roller 2.

In this embodiment, particles of zinc oxide, an n-type semiconductor, are used as the charging performance enhancing particles 2*d* as described before. Zinc oxide particles lose their electrons due to the friction between itself and the peripheral surface of the photosensitive drum; in other words, the charging performance enhancing particles 2*d* are triboelectrically charged to the positive polarity due to the friction between them and the peripheral surface of the photosensitive drum. Since the charge roller is low in electrical resistance, the dominant factor that causes the charging performance enhancing particle 2*d* to be charged is the friction between the charging performance enhancing particles 2*d* and the photosensitive drum 1, not the friction between the charging performance enhancing particles 2*d* and the charge roller 2.

This phenomenon mainly occurs at the entrance portion C of the charging nip n as depicted by FIG. 2, which is a schematic sectional view of the charging nip n and is adjacencies. Since −700 V is being applied to the charge roller 2, the absolute value of the potential level of the peripheral surface of the photosensitive drum 1 is smaller than that of the potential level of the voltage applied to the charge roller 2. Therefore, the charging performance enhancing particles 2*d* are attracted toward the charge roller 2 as indicated by an arrow mark D. In other words, with this setup, it is difficult for the charging performance enhancing particles 2*d* to transfer from the charge roller 2 onto the peripheral surface of the photosensitive drum 1. Also at the exit portion E of the charging nip n, the charging performance enhancing particles 2*d* are attracted toward the charge roller 2 as indicated by an arrow mark F due to the same reason.

With the provision of the above described structure, the charging performance enhancing particles 2*d* on the charge roller 2 remain on the charge roller 2. Therefore, even when the apparatus is continuously used for a long period of time, the charging performance enhancing particles are always present on the charge roller 2 to maintain the satisfactory state of electrical contact between the charge roller 2 and the photosensitive drum 1. It should be noted here that in order for a charging performance enhancing particle to be attracted toward the charge roller 2, the amount of the triboelectric charge of the charging performance enhancing particle 2*d* is desired to be no less than 0.010 $\mu$C/g.

The amount of the triboelectric charge of the charging performance enhancing particles was measured by the following method. That is, the charge roller 2 was placed in the state depicted by FIG. 2, and was rotated ten times without applying voltage to the charge roller 2. During the rotations, the charging performance enhancing particles on the charge roller 2 were collected in a metallic cylinder fitted with a filter, by suction, and the amount of the triboelectrical charge of the charging performance enhancing particles was calculated from the amount Q of the electrical charge stored in a condenser through the metallic cylinder, and the weight M of the charging performance enhancing particles caught in the cylinder. More specifically, the metallic cylinder, that is, a catching device, is fitted with a membrane filter, and the charging performance enhancing particles were suctioned with a force of 200 mm $H_2O$. The catching device was connected to an electrometer (KEITHKEY Co.'s Model 617), so that the amount of the electrical charge of the charging performance enhancing particles caught by the catching device could be measured.

For the reasons given above, the contact type charging apparatus in this embodiment can charge an object with a high level of efficiency that could not be attained by a conventional charge roller or the like. Further, this charging apparatus can charge the photosensitive drum 1 to a potential level substantially the same as the potential level of the voltage applied to the charge roller 2, even though it employs the charge roller 2, as a contact type charging member, which is simple in structure and may be contaminated. In other words, in the case of the charging apparatus in this embodiment, the potential level of the bias which must be applied to the charge roller 2 to charge the photosensitive drum 1 to a given potential level has only to be equivalent to the given potential level. As is evident from the above description of this embodiment, according to the present invention, it is possible to provide a contact type charging apparatus which does not rely on electrical discharge to charge an object, and therefore, is reliable and safe, more specifically, a contact type charging apparatus which is simple in structure, requires relatively low electrical voltage, does not generate ozone, is superior in terms of the uniformity of charge, and is stable for a long period of time.

Embodiment 2

This embodiment is basically the same as the first embodiment, except that unlike the photosensitive drum 1 as an object to be charged in the first embodiment, the photosensitive drum 1 in this embodiment is provided with a charge transfer layer formed of p-type semiconductor, as the surface layer. More specifically, the photosensitive drum 1 in this embodiment comprises an aluminum drum as the base member, and four functional layers: undercoat layer, positive charge injection prevention layer, charge generation layer, and charge transfer layer, which are coated in this order on the peripheral surface of the base member. The charge transfer layer which characterizes this embodiment is formed of p-type semiconductor comprising well-known charge transfer agent belonging to the hydrazone group.

Since the surface layer of the photosensitive drum in this embodiment is of p-type as described above, microscopic particles of carbon, which is not semiconductor, are specifically employed as the charging performance enhancing particles 2*d*. The average diameter of these carbon particles is 3 $\mu$m, and their electrical resistance is $1\times10^2$ ohm.cm.

The rest of the structural configuration of the charging apparatus in this embodiment is the same as that in the first embodiment. Therefore, the charging apparatus in this embodiment was tested in the same manner as the charging apparatus in the first embodiment.

Also in this embodiment, a DC voltage of −700 V was applied to the metallic core 2*a* of the charge roller 2. As a result, electrical charge was directly injected Into the peripheral surface of the photosensitive drum 1, changing the potential level of the peripheral surface of photosensitive drum 1 to a potential level substantially equal to the potential level of the applied voltage.

In this embodiment, the surface layer of the photosensitive drum 1 as an object to be charged, is a charge transfer layer formed of p-type semiconductor. Therefore, as the carbon, particles, or the charging performance enhancing particles 2*d,* come in contact with the peripheral surface of the photosensitive drum 1, the electrons in the carbon particles are supplied to the surface layer of the photosensitive drum 1, causing electron deficiency in the carbon particles In other words, as the carbon particles come in contact with the photosensitive drum 1, they are charged to the positive polarity. Since −700 V is being charged to the charge roller 2, the carbon particles as the charging performance enhancing particles 2*d* are attracted toward the charge roller 2, being electrically impeded from transferring onto the peripheral surface of the photosensitive drum 1.

With the employment of the above described structure, the charging performance enhancing particles (carbon particles) 2*d* remain on the charge roller 2, assuring that satisfactory charging performance is maintained, even when the apparatus is continuously used for a long period of time.

Figure 3:
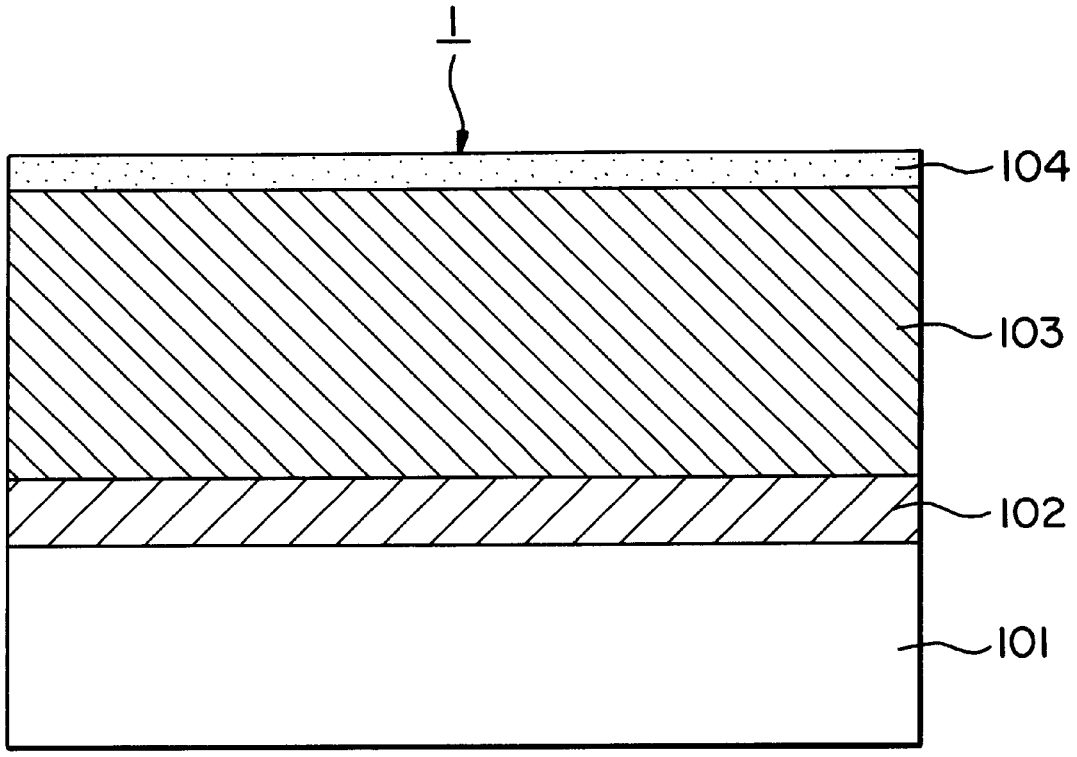
FIG. 3 is a schematic sectional view of the surface portion of the photosensitive drum in the third embodiment, and depicts the laminar structure of the photosensitive drum.

Embodiment 3 (FIG. 3)

This embodiment is substantially the same as the first embodiment. The only difference is that the surface layer of the photosensitive drum 1 as an object to be charged in this embodiment is formed of a-Si (amorphous silicon), an n-type semiconductor.

FIG. 3 is a schematic sectional view of the surface portion of a typical a-Si photosensitive drum, and depicts the laminar structure of the photosensitive drum. The photosensitive layer in this photosensitive drum is not separated into sub-layers with a specific function. In other words, this photosensitive drum is a photosensitive drum of a single layer type. The a-Si photosensitive drum 1 illustrated in FIG. 3 comprises an electrically conductive supporting member 101 formed of aluminum (Al) or the like, and three functional layers: charge injection prevention layer 102, photoconductive layer 103, and surface layer 104, which are coated in this order on the peripheral surface of the supporting member 101.

The charging injection prevention layer 102 is a layer for preventing electrical charge from being injected from the electrically conductive supporting member 101 into the photosensitive layer 103.

The photoconductive layer 103 is formed of non-crystalline material, the requisite component of which is silicon atoms. It displays photoconductivity.

The surface layer 104 is formed of a material which contains silicon atoms and carbon atoms; it is formed of a weak n-type semiconductor, it performs various functions. In particular, it prevents the injection of electrical charge through the peripheral surface of the photosensitive drum 1, and stabilizes the electrophotographic image forming process.

This photosensitive drum was formed with the use of a plasma CVD method (P-CVD method).

In this embodiment, the surface layer of the photosensitive drum is of n-type as described above. Therefore, microscopic particles of carbon, which is not semiconductor, are specifically used as the charging performance enhancing particles 2*d*. The average diameter of these carbon particles is 3 $\mu$m, and their electrical resistance is $1\times10^2$ ohm.cm.

Also in this embodiment, a DC voltage of 500 V is applied as charge bias to the metallic core 2*a* of the charge roller 2.

The rest of the structural configuration of the charging apparatus in this embodiment is the same as that in the first embodiment. Thus, tests were carried out in the same manner as in the first embodiment.

In this embodiment, electrical charge was directly injected into the peripheral surface of the photosensitive drum, charging the potential level of the peripheral surface of the photosensitive drum to a potential level substantially equal to the potential level of the voltage applied to the charge roller 2. However, when a charging apparatus structured as described in this embodiment is in the normal state of usage, that is, after the apparatus is in use for a certain period of time, the peripheral surface of the photosensitive drum is charged to approximately 470 V.

In this embodiment, a photosensitive drum, the surface layer of which is formed of a-Si, that is, an n-type semiconductor, is the object to be charged. Therefore, the carbon particles as the charging performance enhancing particles 2*d* are given electrons from the peripheral surface of the photosensitive drum which is of n-type. In other words, the carbon particles are negatively charged. Since 500 V is applied to the charge roller 2, the negatively charged carbon particles, or the negatively charged charging performance enhancing particles 2*d,* are attracted toward the charge roller 2, being electrically impeded from transferring onto the peripheral surface of the photosensitive drum.

With the provision of the above described structure, the charging performance enhancing particles (carbon particles) 2*d* remain on the charge roller 2, assuring that even when the apparatus is continuously used for a long period of time, a sufficient amount of the charging performance enhancing particles 2*d* is present on the charge roller 2 to maintain the charging performance of the apparatus at a satisfactory level.

This embodiment was described with reference to an a-Si photosensitive drum of a single layer type. However, the effects similar to the above described effects were obtained when this embodiment was applied to an a-Si photosensitive drum of a multiple layer type.

Figure 4:
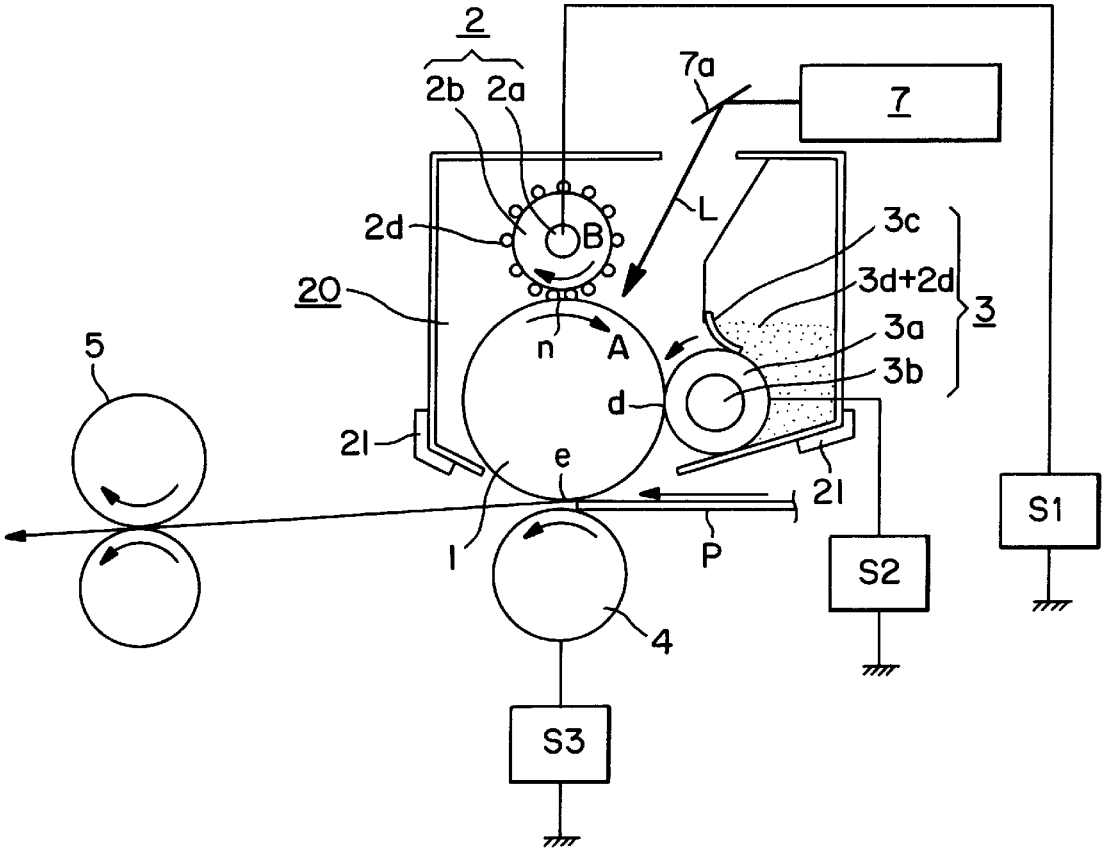
FIG. 4 is a schematic sectional view of the image forming apparatus (cleaner-less) in the fourth embodiment of the present invention, and depicts the general structure of the apparatus.
Figure 5:
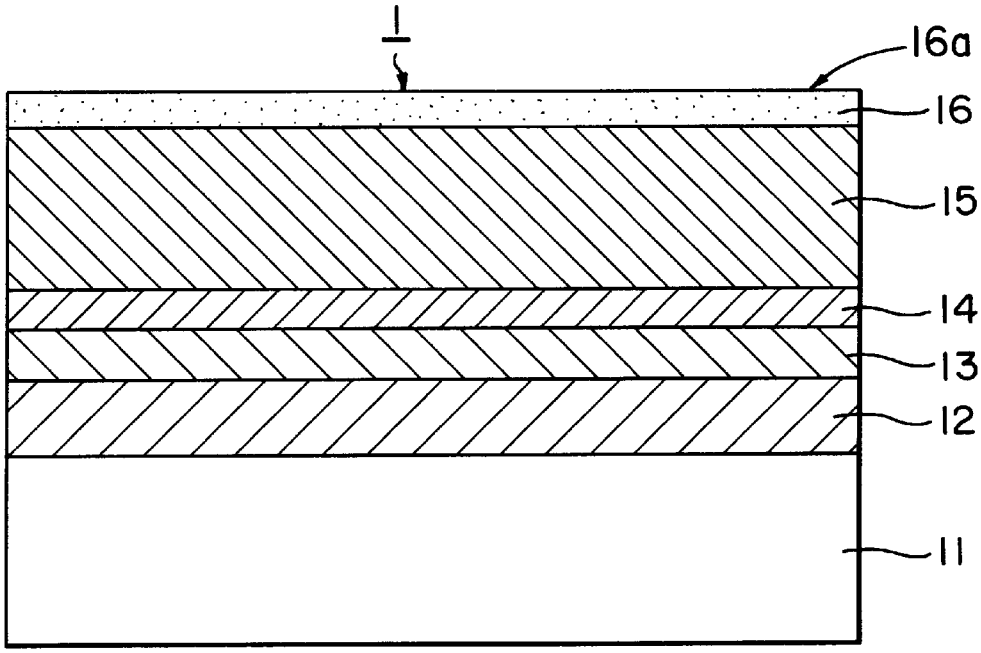
FIG. 5 is a schematic sectional view of the surface portion of the photosensitive drum in the fourth embodiment of the present invention, and depicts the laminar structure of the photosensitive drum.

Embodiment 4 (FIGS. 4 and 5)

This embodiment relates to a cleaner-less layer printer (recording apparatus) which employs a transfer type electrophotographic process, a contact type charging system, and a removably installable process cartridge.

(1) Photosensitive Drum 1

Referring to FIG. 4, a referential character 1 designates a photosensitive drum as an image bearing member (an object to be charged), which is 30 mm in diameter and is rotationally driven in the clockwise direction indicated by an arrow mark A at a peripheral velocity of 50 mm/sec.

FIG. 5 is a schematic sectional view of the peripheral portion of the photosensitive drum 1 in this embodiment, and depicts the laminar structure of the photosensitive drum 1. This photosensitive drum is provided with a charge injection layer 16, which constitutes the surface layer. This photosensitive drum is a photosensitive drum created by coating a charge injection layer 16 on the peripheral surface of an ordinary organic photosensitive drum which comprises a base member 11 (aluminum drum) and four functional layers: an undercoat layer 12, a positive charge injection prevention layer 13, a charge generation layer 14, and a charge transfer layer 15, which are coated in layers in this order on the base member 11. The charge injection layer 16 is coated to improve the performance of an ordinary organic photosensitive member.

The material for the charge injection layer 16 is provided by dispersing microscopic particles 16*a* (approximately 0.03 μm in diameter) of $SnO^2$, that is, electrically conductive particles (electrically conductive filler), lubricant such as tetrafluoroethylene (brand name: Teflon), polymerization initiating agent, and the like, into optically curable acrylic resin, that is, binder. This material is coated on the peripheral surface of an ordinary photosensitive drum, and optically cured into thin film.

The most important aspect of the charge injection layer 16 is the electrical resistance of its surface layer. In a charging system based on a direct charge injection principle, reducing the electrical resistance on the side of an object to be charged improves the efficiency with which electrical charge is exchanged. On the other hand, when the charge injection layer constitutes the surface layer of an image bearing member (photosensitive member), the proper range for the volumetric resistivity value of the charge injection layer 16 is $1\times10^9$–$1\times10^{14}$ (ohm.cm), because an image bearing member must be able to sustain an electrostatic latent image for a certain length of time.

(2) Charge Roller 2

A referential character 2 designates an electrically conductive elastic layer as a contact type charging member to be placed in contact with the photosensitive drum 1. It is similar to the charge roller in the first embodiment.

The peripheral surface of this charge roller 2 is coated in advance with the charging performance enhancing particles 2*d* to enable the charge roller 2 to properly charge the photosensitive drum 1 from the very beginning of a charging process.

The peripheral surface of the charge roller 2 is directly pressed upon the peripheral surface of the photosensitive drum 1 with the application of a predetermined amount of pressure against the elasticity of the charge roller 2 so that a charging nip n (charging station) with a predetermined width is formed between the charge roller 2 and photosensitive drum 1.

The charge roller 2 in this embodiment is rotationally driven at 80 rpm in the clockwise direction indicated by an arrow mark B so that in the charging nip n, the peripheral surface charge roller 2 moves in the direction opposite (counter) to the moving direction of the peripheral surface of the photosensitive drum 1, at approximately the same velocity as that of the photosensitive drum 1. In other words, the peripheral surface of the charge roller 2 is placed in contact with the peripheral surface of the photosensitive drum 1 so that a difference in peripheral velocity is present between the two components.

(3) Exposing Apparatus 7

A referential character 7 designates an exposing apparatus (exposing device). In this embodiment, it is a laser beam scanner which comprises a laser diode, a polygon mirror, and the like. This laser beam scanner 7 outputs a laser beam L (laser beam), the intensity of which is modulated with sequential digital image signals which reflect the data of an original image. This laser beam L scans, or exposes, the uniformly charged peripheral surface of the aforementioned photosensitive drum 1 which is being rotated. A referential character 7*a* designates a mirror which deflects the laser beam which the laser scanner 7 outputs, toward the exposing station in which the photosensitive drum 1 is exposed. As the scanning laser beam L exposes the peripheral surface of the photosensitive drum 1, an electrostatic latent image is formed in accordance with the image formation data for the target image, or the original image, on the peripheral surface of the photosensitive drum 1.

(4) Developing Apparatus 3

A referential character 3 designates a developer device. The electrostatic latent image on the peripheral surface of the rotational photosensitive drum 1 is developed into a toner image, that is, an image formed with toner, by this developing device 3. The developing device 3 in this embodiment is a reversal type developing apparatus, and uses single component magnetic toner 3*d* (negative toner). Designated by a referential character 3*a* is a nonmagnetic rotation development sleeve that contains a stationary (nonrotational) magnetic roller 3*b*. It is rotationally driven at a predetermined peripheral velocity in the clockwise direction indicated by an arrow mark.

Electrically insulative magnetic toner 3*d* comprises a single component is stored in the developing apparatus. As the development sleeve 3*a* rotates, the toner 3*d* is magnetically held in a layer on the peripheral surface of the development sleeve 3 by the magnetic force of the magnetic roller 3*b*, and is conveyed to a development station d between the photosensitive drum 1 and the development sleeve 3*a* by the rotation of the development sleeve 3*a*. The development station is the station in which the peripheral surfaces of the photosensitive drum 1 and development sleeve 3*a* squarely face each other. During this conveyance, the layer of the toner 3*d* on the development sleeve 3 is regulated in thickness, while being triboelectrically charged, by a regulator blade 3*d*. As the layer of the toner 3*d* on the development sleeve enters the development station d, the toner 3*d* reversely develops the electrostatic latent image on the peripheral surface of the rotating photosensitive drum 1, into a toner image.

To the development sleeve 3*a,* development bias, that is, electrical voltage, is applied from a development bias application power source S2.

The single component, magnetic, insulative toner 3*d* as the developer in this embodiment comprised binding resin, coloring material, magnetic particles, and agent for controlling electrical charge, through the processes of mixing, kneading, pulverizing, and classifying. Further, external additives such as fluidizer were added to the thus produced toner. The weight average particle diameter (D4) of the toner was 7 $\mu$m.

(5) Charging Performance Enhancing Particles 2*d*

As described above, not only are the charging performance enhancing particles 2*d* coated in advance on the peripheral surface of the charge roller 2, but also are mixed into the magnetic, single component, insulative toner 3*d,* or the developer, stored in the above described developing apparatus 3 at a predetermined ratio.

The charging performance enhancing particles employed in this embodiment are the same n-type semiconductor as those in the first embodiment. In other words, they are particles of electrically conductive zinc oxide. The average diameters of the particles was 4.5 $\mu$m, and their ratio relative to the developer was one part in weight.

When the charging performance enhancing particles 2*d* are used for charging a photosensitive member, they are desired to be colorless or white particles so that they do not interfere with the process for exposing the photosensitive member to form a latent image.

Further, in consideration of the fact that some of the charging performance enhancing particles are transferred onto the recording medium from a photosensitive member, the charging performance enhancing particles used in color recording are desired to be colorless or white, and also nonmagnetic. Further, in order to prevent exposing light form being scattered by the charging performance enhancing particles while the peripheral surface of a photosensitive drum is exposed for image formation, the diameter of a charging performance enhancing particle is desired to be less than the size of a picture element. From the standpoint of particle stability, the smallest value for the diameter of a charging performance enhancing particle seems to be 10 nm.

(6) Transferring Means 4

A referential character 4 designates an elastic, rotational transfer roller as a contact type means for transferring an image. Its electrical resistance is in a medium range. It is placed in contact with the photosensitive drum 1 with the application of a predetermined amount of pressure to form a transfer nip e (transfer station).

To this transfer nip e, a recording sheet P as a recording medium (transfer medium) is delivered with a predetermined timing from an unillustrated sheet feeding station. As the recording medium P is passed through the transfer nip e, transfer bias, or electrical voltage with a predetermined potential level, is applied to the transfer roller 4 from a transfer bias application power station S3. As a result, the toner image on the photosensitive drum 1 is continuously transferred, starting from the leading end, onto the surface of the recording medium P.

The polarity to which the charging performance enhancing particles is charged is opposite to the polarity to which the toner is charged. Therefore, the charging performance enhancing particles which adhered to the photosensitive drum are not transferred onto the recording medium P and are conveyed back to the charging nip n.

(7) Fixing Apparatus 5

A referential character 5 designates a thermal fixing apparatus. After being delivered to the transfer nip e, and receiving a toner image from the photosensitive drum 1, the recording medium P is separated from the photosensitive drum 1 and is introduced into this fixing apparatus 5, in which the toner image is fixed to the recording medium P. Then, the recording medium P is discharged as a print or a copy from the image forming apparatus.

The printer in this embodiment is a cartridge type printer. In other words, it employs a cartridge 20 which integrally comprises the photosensitive drum 1 and two processing devices; charge roller 2 as a contact type charging member, and developing apparatus 3, and is removably installable into the main assembly of the printer. The combination of the processing devices which are to be integrally placed in a process cartridge does not need to be limited to the above described combination; it is optional. Referential characters 21 and 21 designate members for holding and guiding the process cartridge 20 during the installation or removal of the process cartridge 20. Further, an image forming apparatus to which the present invention is applicable is not limited to a cartridge type image forming apparatus.

(8) Charging by Direct Injection

A toner image developed on the photosensitive drum 1 is transferred onto a recording medium P. However, some of the toner which forms the toner image remains as residual toner on the photosensitive drum 1. Since the printer in this embodiment is cleaner-less, the transfer residual toner is carried intact to the charging nip n between the photosensitive drum 1 and charge roller 2. The toner is electrically insulative by nature. Therefore, as the transfer residual toner is carried to the charging nip n, it becomes one of the causes of improper charging of the photosensitive drum 1.

In this embodiment, however, the peripheral surface of the charge roller 2 is coated in advance with the charging performance enhancing particles 2*d;* in other words, the charging performance enhancing particles 2*d* are present before the starting of an image forming operation. Further, through the development and transfer processes, the charging performance enhancing particles 2*d* mixed in the developer 3*d* in the developing apparatus 3 are carried to the nip n between the photosensitive drum 1 and charge roller 2, in which they are supplied to the charge roller 2. Therefore, even if the toner is adhered to the charge roller 2, a proper state of electrical contact and a proper amount of friction are maintained by the charging performance enhancing particles 2*d* which are present in the nip n, assuring that the charging apparatus in this embodiment is enabled to directly inject a proper amount of electrical charge into the photosensitive drum 1, from the very beginning of the apparatus usage, and even after a long period of the continuous apparatus usage.

Also in this embodiment, a DC voltage of −700 V was applied to the metallic core 2*a* of the charge roller 2 as described before. As a result, electrical charge was directly injected into the peripheral surface of the photosensitive drum 1, changing the potential level of the peripheral surface of photosensitive drum 1 to a potential level substantially equal to the potential level of the applied voltage. After a charging apparatus structured as described in this embodiment was in use for a while, the peripheral surface of the photosensitive drum 1 was charged to approximately −650 V.

As described before, in this embodiment, particles of zinc oxide, which is an n-type semiconductor, is used as the charging performance enhancing particles 2*d*. Thus, as described in the first embodiment, as the zinc oxide particles come in contact with the peripheral surface of the photosensitive drum 1, the electrons in the carbon particles are supplied to the surface layer of the photosensitive drum 1, causing electron deficiency in the zinc oxide particles. In other words, as the carbon particles come in contact with the photosensitive drum 1, they are triboelectrically charged to the positive polarity. Since −700 V is being charged to the charge roller 2, the charging performance enhancing particles 2*d* are attracted toward the charge roller 2 as indicated by arrow marks D and F in FIG. 6, electrically impeded from transferring onto the peripheral surface of the photosensitive drum 1.

With the employment of the above described structure, the charging performance enhancing particles 2*d* on the charge roller 2 remain on the charge roller 2, assuring that there are always the charging performance enhancing particles 2*d* in the charging nip n to maintain satisfactory charging performance, even when the apparatus is continuously used for a long period of time.

(9) Cleaner-less System

Figure 6:
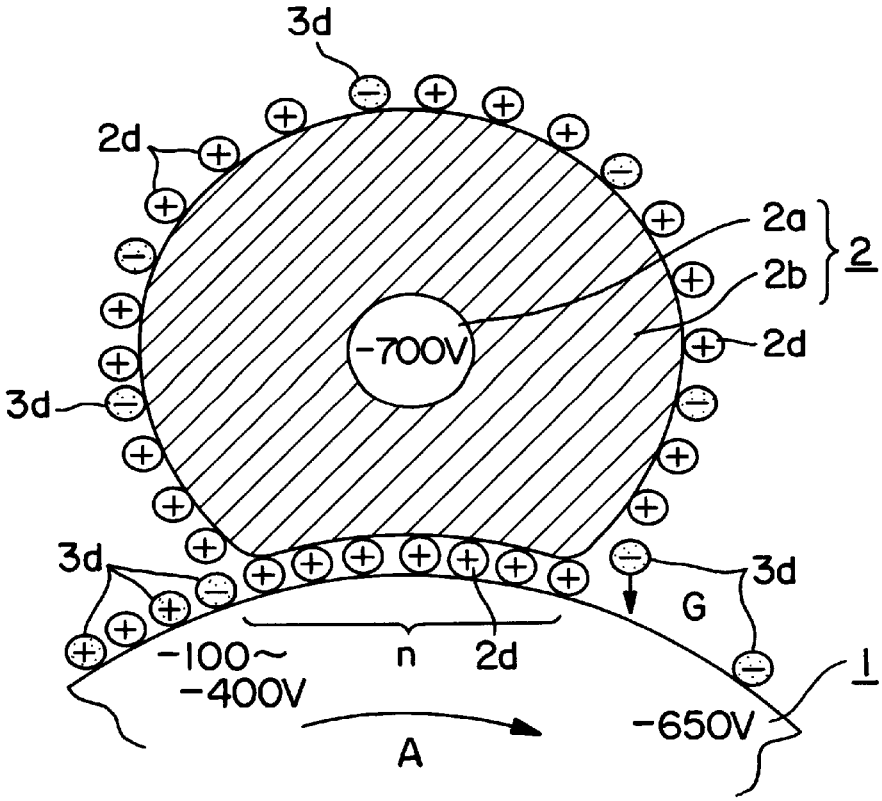
FIG. 6 is a schematic drawing for describing a direct charge injection process which involves the presence of charging performance enhancing particles, and also for describing how the toner particles which remained on the photosensitive member after image transfer and mixed into the charging performance enhancing particles, are expelled from among the charging performance enhancing particles.
Figure 7:
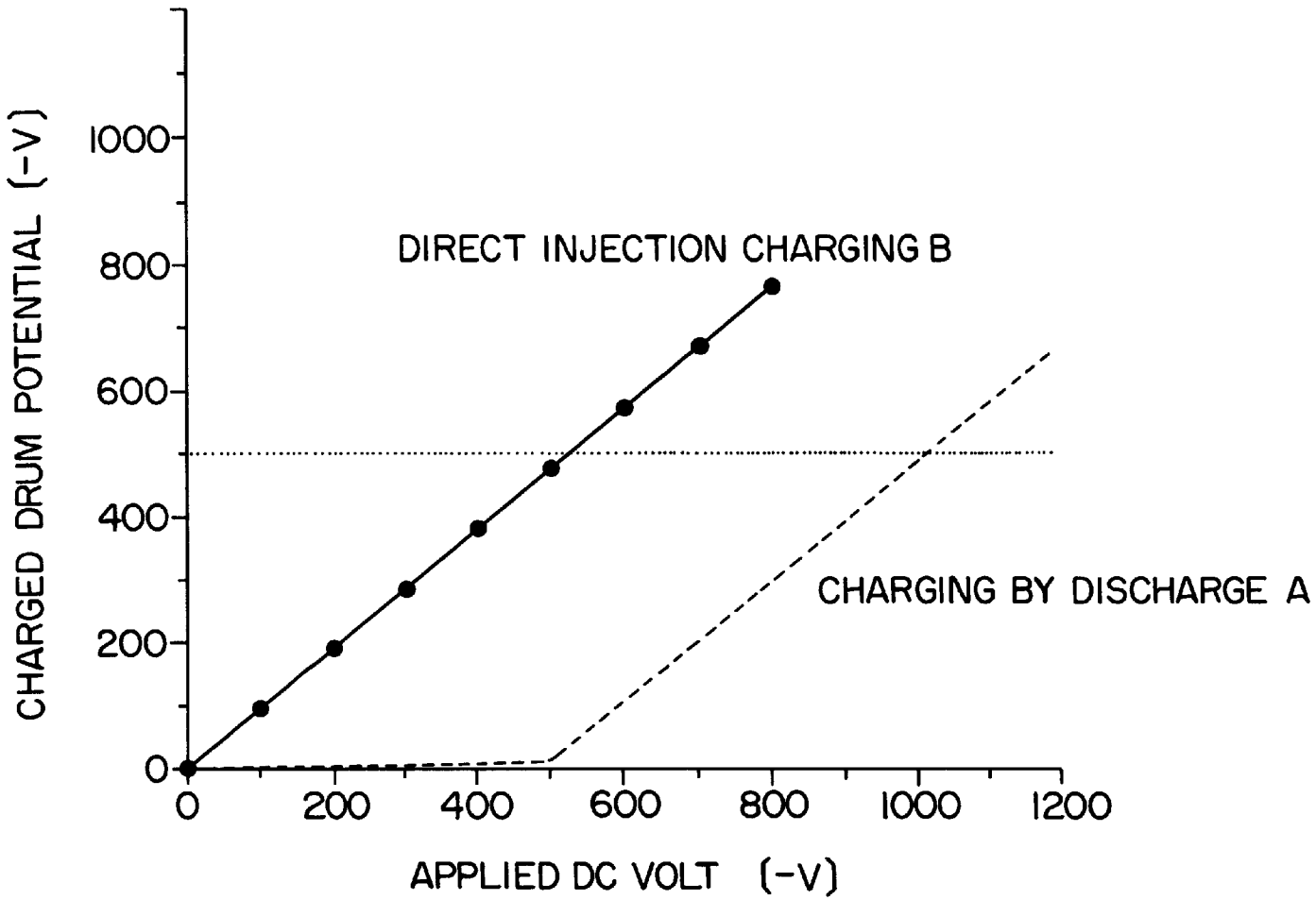
FIG. 7 is a graph which shows the characteristics of different charging mechanisms.

As described previously, because the printer is cleaner-less, it is more often than not that the transfer residual toner 3*d* is reversed in polarity (from negative polarity to positive polarity, in this embodiment) by transfer bias, the electrical discharge caused by recording medium separation, and/or the like, by the time it arrives at the nip n between the photosensitive drum 1 and charge roller 2 by being carried on the photosensitive drum 1. As a result, the transfer residual toner 3*d* with the reversed polarity adhered to the charge roller 2 or mixes with the charging performance enhancing particles 2*d* as depicted by FIG. 6, a schematic sectional drawing. Then, the transfer residual toner 3*d* is reversed again in polarity (positive to negative, in this embodiment) by the friction between itself and the peripheral surface of the photosensitive drum 1, and between itself and the charging performance enhancing particles 2*d*. As a result, the transfer residual toner 3*d*, which at this point is negatively charged, is electrically expelled (direction indicated by an arrow mark G in FIG. 6) from the charge roller 2 onto the photosensitive drum 1 little by little. In this case, as the transfer residual toner adheres to the charge roller 2 or mixes with the charging performance enhancing particles 2*d*, the adhesive force of the transfer residual toner is reduced due to the presence of the charging performance enhancing particles 2*d* on the charge roller 2, improving the efficiency with which the transfer residual toner is expelled from the charge roller 2 onto the photosensitive drum 1.

After being expelled from the charge roller 2 onto the photosensitive drum 1, the toner is conveyed by the movement of the peripheral surface of the photosensitive drum 1 to the development station d, in which it is recovered (developing-cleaning process) by the developing apparatus to be used for image development (toner recycle).

In the developing-cleaning process, the transfer residual toner is recovered into the developing apparatus by fog removal bias Vback, that is, the difference in potential level between the DC voltage applied to the developing apparatus and the peripheral surface of the photosensitive drum, during the latent image developing process in the immediately following image forming cycle in which the portion of the photosensitive drum, on which the transfer residual toner remains, is charged and exposed to form a latent image. In a reversal development such as the one used in this embodiment, the developing-cleaning process is carried out by the electric field for transferring toner from the "dark" potential portions of the photosensitive drum onto the development sleeve, and the electric field for adhering toner from the development sleeve onto the "light" potential portions of the photosensitive drum.

With the repetition of the above described process, electrical charge can be directly injected, while recycling toner, for a long period of time. Since the transfer residual toner and charging performance enhancing particles are adhered, while being stirred and mixed, to the charge roller 2, images which do not suffer from the ghosts traceable to transfer residual toner can be outputted.

To summarize, although the image forming apparatus in this embodiment is a cleaner-less apparatus, it is equipped with the photosensitive drum 1 with the charge injection layer 16, and the charging apparatus which employs the particles n-type semiconductor as the charging performance enhancing particles 2*d*. Therefore, the images formed by this apparatus do not suffer from such a ghost that is effected by the transfer residual toner which slips by the charging nip n, and/or the improper charging of the photosensitive drum 1 caused also by the transfer residual toner which slips by the charging nip n. In particular, it is characterized by not suffering from image defects such as a ghost that results from the blocking of the exposing light by the charging performance enhancing particles.

<Miscellaneous>

1) The choice of the charge roller 2 as a flexible contact type charging member does not need to be limited to the charging rollers described in the preceding embodiments.

In addition to the above described charge roller 2, contact type charging members different in material and shape may be employed as a flexible contact type charging member; for example, a fur brush, a piece of felt, a piece of fabric, and the like. Further, these members may be employed in combination to obtain better elasticity and electrical conductivity.

2) When an AC voltage (alternating voltage, that is, voltage which periodically changes in potential level) is included in the bias applied to the contact type charging member 2 and development sleeve 3*a*, the wave-form of the AC voltage is optional: it may be sinusoidal, rectangular, triangular, or the like. The bias may be an alternating voltage with a rectangular wave-form, which is generated by periodically turning on and off a DC power source. In other words, any voltage which periodically changes in potential level may be used as the aforementioned bias; the wave-form of the alternating voltage is optional.

3) The selection of an exposing means for forming an electrostatic latent image does not need to be limited to a laser based scanning type exposing means, such as the one in the preceding embodiments, which digitally forms a latent image. It may be an ordinary analog type exposing means, a light emitting element such as an LED, a combination of a light emitting element such as a fluorescent light and a liquid crystal shutter, or the like. In other words, any exposing means may be employed as long as it can form an electrostatic latent image in accordance with image formation data.

4) The image bearing member may be an electrostatically recordable dielectric member or the like. In this case, an electrostatic latent image of an original is written on the surface of a dielectric member by removing electrical charge from selected points of the surface of the dielectric member with the use of a charge removing means such as a charge removing head, an electron gun, or the like, after the surface of the dielectric member is uniformly charged (primary charge) to predetermined polarity and potential level.

5) In these preceding embodiments, the developing means 3 was described with reference to a reversal type developing apparatus which used single component magnetic toner. However, there is no restriction regarding the developing apparatus structure. The developing means 3 may be a developing apparatus which employs a normal development process.

6) The transferring means 4 does not need to be limited to a transferring means which employs a transfer roller. It may be a transfer means which employs a transfer belt, or a transferring means which relies on corona discharge. In other words, the choice of the transferring means 4 is optional.

7) The image forming apparatus may be an image forming apparatus which employs an intermediary transfer member such as a transfer drum or transfer belt, and forms not only a monochromatic image, but also a multi-color image or a full-color image through a multi-layer transfer process or the like.

8) The choice of an image forming apparatus does not need to be limited to a transfer type image forming apparatus. It may be a direct type image forming apparatus, or an image forming apparatus which displays an image through a displaying device.

Effects of the Invention

As described above, according to the present invention, the potential level of the bias which must be applied to a contact type charging member to electrically charge an object to a predetermined potential level may be substantially the same as the predetermined potential level for the object, in spite of the fact that when a simple charging member such as a charge roller or a fur brush is employed as a contact type charging member, it is contaminated. Therefore, it is possible to realize a safe and reliable contact type charging apparatus which does not rely on electrical discharge, more specifically, a direct injection type charging apparatus which requires only low voltage, does not product ozone, is superior in terms of the uniformity of charge, is durable, and yet is simple in structure.

The employment of a charging apparatus in accordance with the present invention as a charging means for charging the image bearing member of an image recording apparatus which employs a contact type charging system, an image recording apparatus which employs both a contact type charging system and a transfer system, or an image recording apparatus which employs a contact type charging system, a transfer system, and a toner recycling system, makes it possible to directly inject electrical charge into the image bearing member with the use of low voltage and a simple component such as a charge roller or a fur brush as a contact type charging member, while recycling the transfer residual toner, without producing ozone, in spite of the contamination of the contact type charging member, so that high quality images can be continuously outputted for a long period of time, even after a copy with a high image ratio is outputted.

Further, according to the present invention, a charging apparatus is structured to facilitate the charging performance enhancing particles, which makes possible the satisfactory direct charge injection, to electrically adhere to the peripheral surface of a contact type charging member. Consequently, the peripheral surface of the contact type charging member is always covered with a sufficient amount of the charging performance enhancing particles when it comes in contact with an object to be charged (image bearing member). Therefore, the state of electrical contact between the contact type charging member and the object to be charged is far better than it used to be, enabling the contact type charging member to directly inject electrical charge into the object to be charged, to uniformly charge the object.

Further, according to the present invention, an image which is uniform in texture, and does not suffer from a ghost which is generated by the transfer residual toner, can be outputted even by an image forming apparatus which does not have a cleaning apparatus.

While the invention has been described with reference to the structures disclosed herein, it is not confined to the details set forth and this application is intended to cover such modifications or changes as may come within the purposes of the improvements or the scope of the following claims.

What is claimed is:

1. A charging apparatus for charging a member to be charged, comprising:

a charging member having an elastic layer which is press-contacted to the member to be charged to electrically charge it;

charging performance enhancing particles existing at a contact portion between said charging member and the member to be charged; and wherein the charging performance enhancing particles are triboelectrically charged at the contact portion to a polarity opposite from that of a voltage applied to said charging member.

2. An apparatus according to claim 1, wherein said charging member is movable with a peripheral speed difference relative to the member to be charged.

3. An apparatus according to claim 1, wherein said charging member charges the member to be charged by flowing electric current to the member to be charged substantially without electric discharging.

4. An apparatus according to claim 1, wherein the charging performance enhancing particles are triboelectrically charged at the contact portion mainly by friction with the member to be charged.

5. An apparatus according to claim 1, wherein a charging polarity of the member to be charged is negative, and the charging performance enhancing particles comprise n-type semiconductor.

6. An apparatus according to claim 1, wherein a charging polarity of the member to be charged is negative, and the member to be charged have surface layer comprising p-type semiconductor.

7. An apparatus according to claim 1, wherein a charging polarity of the member to be charged is positive, and the charging performance enhancing particles comprise n-type semiconductor.

8. An apparatus according to claim 1, wherein a charging polarity of the member to be charged is positive, and the member to be charged have surface layer comprising n-type semiconductor.

9. An apparatus according to claim 1, wherein the charging performance enhancing particles have a resistance of not more than $10^{12}$ Ohm.cm.

10. An apparatus according to claim 1, wherein the charging performance enhancing particles have an average particles size smaller than that of toner particles.

11. An apparatus according to claim 1, wherein the member to be charged has a volume resistivity of $10^{9}$–$10^{14}$ Ohm.cm.

12. An apparatus according to claim 1, wherein an amount of charge of the charging performance enhancing particles is not less than 0.010 $\mu$C/g.

* * * * *

UNITED STATES PATENT AND TRADEMARK OFFICE

CERTIFICATE OF CORRECTION

PATENT NO. : 6,163,671
DATED : December 19, 2000
INVENTOR(S) : Harumi Ishiyama, et al.

It is certified that error appears in the above-identified patent and that said Letters Patent is hereby corrected as shown below:

Title Page
Under [57] Abstract, line 6, "is" should read --are--.

Column 1,
Line 57, "mechanism:" should read --meahcnisms:--.

Column 3,
Line 8, "charge" should read --charged--.

Column 4,
Line 9, "a a" should read --at a--; and
Line 55, "term" should read --terms--.

Column 8,
Line 55, "comprises" should read --comprised--; and
Line 56, "comprises" should read --comprised--.

Column 10,
Line 14, "is" should read --its--.

UNITED STATES PATENT AND TRADEMARK OFFICE

CERTIFICATE OF CORRECTION

PATENT NO. : 6,163,671
DATED : December 19, 2000
INVENTOR(S) : Harumi Ishiyama, et al.

It is certified that error appears in the above-identified patent and that said Letters Patent is hereby corrected as shown below:

Column 11,
Line 43, "Into" should read --into--.

Column 14,
Line 53, "comprises" should read --comprising--.

Column 19,
Line 33, "product" should read --produce--.

Column 20,
Line 17, "it;" should read --it; and--;
Line 21, "charged; and" should read --charged,--;
Line 44, "have" should read --has a--;
Line 52, "have" should read --has a--; and
Line 59, "particles" (first occurrence) should read --particle--.

Signed and Sealed this

Fourteenth Day of August, 2001

*Attest:*

Nicholas P. Godici

*Attesting Officer*

NICHOLAS P. GODICI
*Acting Director of the United States Patent and Trademark Office*